US005647285A

United States Patent [19]

Steward

[11] Patent Number: 5,647,285

[45] Date of Patent: Jul. 15, 1997

[54] FOLDING ARTICLE OF FURNITURE

[76] Inventor: Ronald L. Steward, 8284 174th Ave. North, Ramsey, Minn. 55303

[21] Appl. No.: 585,156

[22] Filed: Jan. 11, 1996

[51] Int. Cl.[6] ..... A47B 3/02

[52] U.S. Cl. ..... 108/119

[58] Field of Search ..... 108/119, 118, 108/115; 248/188.6

[56] References Cited

U.S. PATENT DOCUMENTS

| | | | |
|---|---|---|---|
| D. 331,505 | 12/1992 | Sylvester | 108/119 X |
| 362,379 | 5/1887 | Henry | 108/119 |
| 415,841 | 11/1889 | Lee | 108/119 |
| 524,658 | 8/1894 | Washburn | 108/119 X |
| 1,295,073 | 2/1919 | Schwartz et al. | 108/119 |
| 1,411,854 | 4/1922 | Leonard | 108/119 X |
| 1,961,241 | 6/1934 | McKenney | 108/119 X |
| 2,191,007 | 2/1940 | Bussey | 108/119 X |
| 3,224,389 | 12/1965 | Kent | 108/119 |
| 3,311,071 | 3/1967 | Cook | 108/119 |

*Primary Examiner*—Jose V. Chen
*Attorney, Agent, or Firm*—David L. Volk; Brendan B. Dix

[57] ABSTRACT

A panel portion includes at least two side pieces attached thereto, each of the side pieces containing a side piece notch and a side piece aperture. Two outer legs each contain an outer leg aperture and an outer leg bolt aperture. Two inner legs each contain an inner leg notch and an inner leg aperture. A bolt connects the outer leg to the inner leg, the bolt disposed within the outer leg bolt aperture and the inner leg aperture. A crossmember is attached to each of the side pieces and the panel portion. A joining piece is attached within each of the inner leg notches. A dowel is disposed within each of the outer leg apertures and each of the side piece apertures. Each of the inner legs has an inner leg top width edge opposite and parallel to an inner leg bottom width edge, and an inner leg bevel perpendicular to the inner leg top width edge. Each of the outer legs has an outer leg top width edge opposite and parallel to an outer leg bottom width edge, and an outer leg bevel perpendicular to the outer leg top width edge. The side piece notch is configured to conformingly receive the inner leg top width edge and the inner leg bevel therein.

3 Claims, 3 Drawing Sheets

FOLDING ARTICLE OF FURNITURE

BACKGROUND OF THE INVENTION

1. Field of the Invention

The present invention relates to furniture; specifically to a folding utility stool, bench or table.

2. Description of the Prior Art

Numerous innovations for a folding utility stool, bench or table have been provided in the prior art that are described as follows. Even though these innovations may be suitable for the specific individual purposes to which they address, they differ from the present invention as hereinafter contrasted.

For example, U.S. Pat. No. 284,529 to Adrian Reed, teaches an ornamental design for a folding stool. The patented invention is not a utility patent and cannot be used in a folded position. Furthermore, the present invention does not have a similar configuration to the patented design.

Another example, U.S. Pat. No. 3,467,033 to Marvin Sienkiewicz and Russell Remer, teaches a folding seat having a hinged post member adapted to be restrained from pivoting by means of a slidable sleeve. The seat has a socket member affixed in its underside and the post is slidable and pivotally received therein by means of a pair of ears depending downwardly from the socket member. Each of the ears has an inwardly extending nipple and the upper section of the post has a pair of slots which receive the nipples and slide with respect thereto when the post is slid into or withdrawn from the socket. Stops are provided for limiting this sliding movement such that the post may be withdrawn from the socket a sufficient distance to allow it to pivot between the ears into abutment with the seat and slide with respect thereto and, yet, remain connected to the socket assembly.

The present invention differs from the above described patented invention in that the patented invention utilizes a hinged post member that has a slidable sleeve for folding the invention, while the present invention utilizes inner and outer legs and dowel configuration for folding the invention. Furthermore, the patented invention cannot be used in its folded position, while the present invention can be used in its folded position.

Another example, U.S. Pat. No. 3,709,167 to Arthur Sprigman, teaches a folding stool with legs and separate seat braces that extend from and are pivotally attached to a hub. When the stool is unfolded, the legs are retained in their normal, load supporting positions by angularly disposed edges on their minor portions, and the seat braces are also retained in their normal, load supporting positions. The legs can be folded to overlap the seat braces so that the stool can be folded the length of the legs or seat braces, whichever are longer.

The present invention differ from the above described patented invention for the following reasons: firstly, the patented invention utilizes separate seat braces and a hub to allow for the folding of the stool; secondly, the braces are pivotally attached to the hub, whereas the present invention does not utilize a hub, braces or any mechanism with similar functions. Furthermore, the patented invention cannot be used in its folded position.

Another example, U.S. Pat. No. 4,148,523 to Peter Brand, Guenther Haefner, Frietz Diedrich, and Hans Kirchmann, teaches a work stool used for a higher than normal seating position as required when working at a drafting table or the like. Features of the invention include a fight weight frame that folds for storage, a wide base that does not interfere with the user's feet, and a vertically adjustable seat having a textured face for ventilation.

The present invention differs from the above described patented invention in that the patented invention has a seat vertically adjustable on its frame, a closed frame for supporting a seat, a forward projecting seat and rearwardly extending floor brace which widens as it reaches the floor, while the present invention features legs, not a brace, and does not have a forward projecting seat or a closed frame. Furthermore, the patented invention cannot be used in its folded position.

Another example, U.S. Pat. No. 4,290,502 to John B. Anderson, teaches a folding step stool that when folded the step stool is self standing and has a narrow width to permit the step stool to be stored in otherwise unusable spaces. When the legs are extended, a stable triangular support for two or more steps is provided. The vertical uprights of the device carry a handgrip positioned well above the level of the highest step to be useful when a person is on the highest step and during ascent and descent of the steps.

The present invention differs from the above described patented invention in that the patented invention utilizes a three dowel system to fold the invention, where one of the dowels moves along a slot while the present invention utilizes only one dowel which remains stationary at all times. Furthermore, the patented invention cannot be used in its folded position.

Another example, U.S. Pat. No. 5,044,690 to Ralph Torrey, teaches a folding stool comprising of a pair of hinged seat supports connected to a pair of hinged leg supports by way of a pair of pivots in a manner such that the leg supports fold up and fit within the seat supports thus making a compact package convenient to carry and store. Hinged leg supports and hinged seat supports cross each other in the point of the pivots in substantially X form when the stool is open and in use. The leg supports are connected to each other by means of a flexible double acting hinge permitting rotation of the leg supports over the 180 degree horizontal, and moving in concert about the pivots, leg supports and seat supports are brought into a position suitable for supporting an adult user at a comfortable, normal chair height. A readily detachable and foldable seat stretches across the top of and engages the seat support preventing further opening of the stool. With the stool folded, the seat fits snugly between folded support members presenting a compact storage package convenient to carry and store.

The present invention differs from the above described patent in that the present invention remains one piece at all times and can be used in its folded position. Furthermore, the patented invention utilizes hinged leg supports connected by a double acting hinge while the present invention does not use this or any other similar configuration.

Numerous innovations for a folding stool, bench, or table have been provided in the prior art that are adapted to be used. Even though these innovations may be suitable for the specific individual purposes to which they address, they would not be suitable for the purposes of the present invention as heretofore described.

SUMMARY OF THE INVENTION

The article of furniture of the present invention includes a panel portion, at least two side pieces attached to the panel portion, at least two outer legs and at least two inner legs. A crossmember is attached to each of the side pieces and to the panel portion. The outer leg is rotatably connected to the inner leg.

Each inner leg includes an inner leg notch. A joining piece is attached within the inner leg notch of each inner leg. A dowel is disposed within an outer leg aperture of each outer leg, and within a side piece aperture of each side piece.

Each side piece includes a side piece notch which receives an inner leg bevel of the inner leg.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWING

| | |
|---|---|
| 10 - article of furniture | 12 - panel portion |
| 12A - panel portion longitudinal edge | 12B - panel portion width edge |
| 14 - outer leg | 14A - outer leg width bottom edge |
| 14B - outer leg bevel | 14C - outer leg aperture |
| 14D - outer leg longitudinal edge | 14E - outer leg bolt aperture |
| 14F- outer leg width top edge | 15 - bolt |
| 15A - nut | 16 - inner legs |
| 16A - inner leg longitudinal edge | 16E - inner leg aperture |
| 16F - inner leg bevel | 16G - inner leg notch |
| 16H - inner leg width end | 17 - side piece |
| 17A - side piece aperture | 17B - side piece notch first edge |
| 17C - side piece notch top edge | 17D - side piece notch second edge |
| 17E - side piece width edge | 17G - side piece longitudinal edge |
| 17H - side piece notch | 17I - side piece groove |
| 17J - side piece slot | 18 - joining piece |
| 19 - dowel | 19A - dowel first end |
| 19B - dowel second end | 20 - crossmember |
| 20A - crossmember longitudinal edge | 20C - crossmember width edge |

DESCRIPTION OF THE PREFERRED EMBODIMENT

Figure 1:
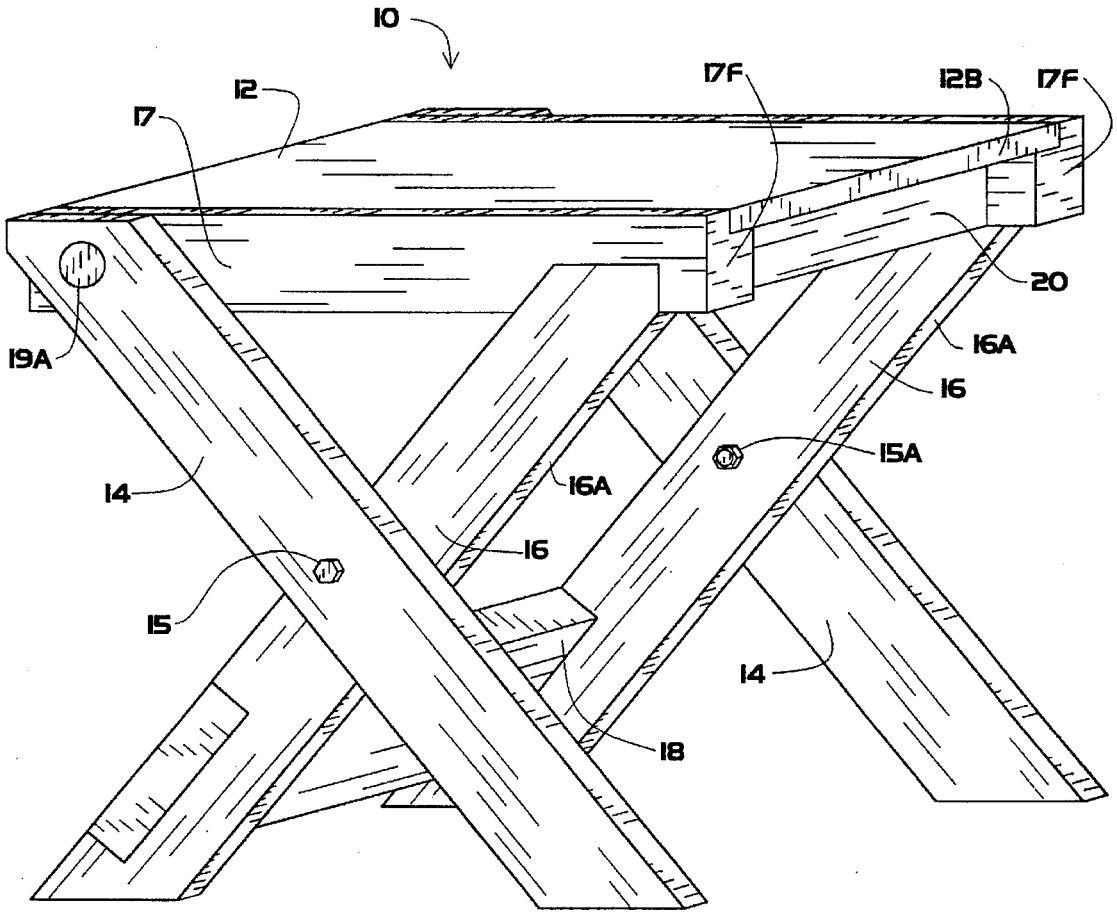
FIG. 1 is a perspective of the folding article of furniture.
Figure 2:
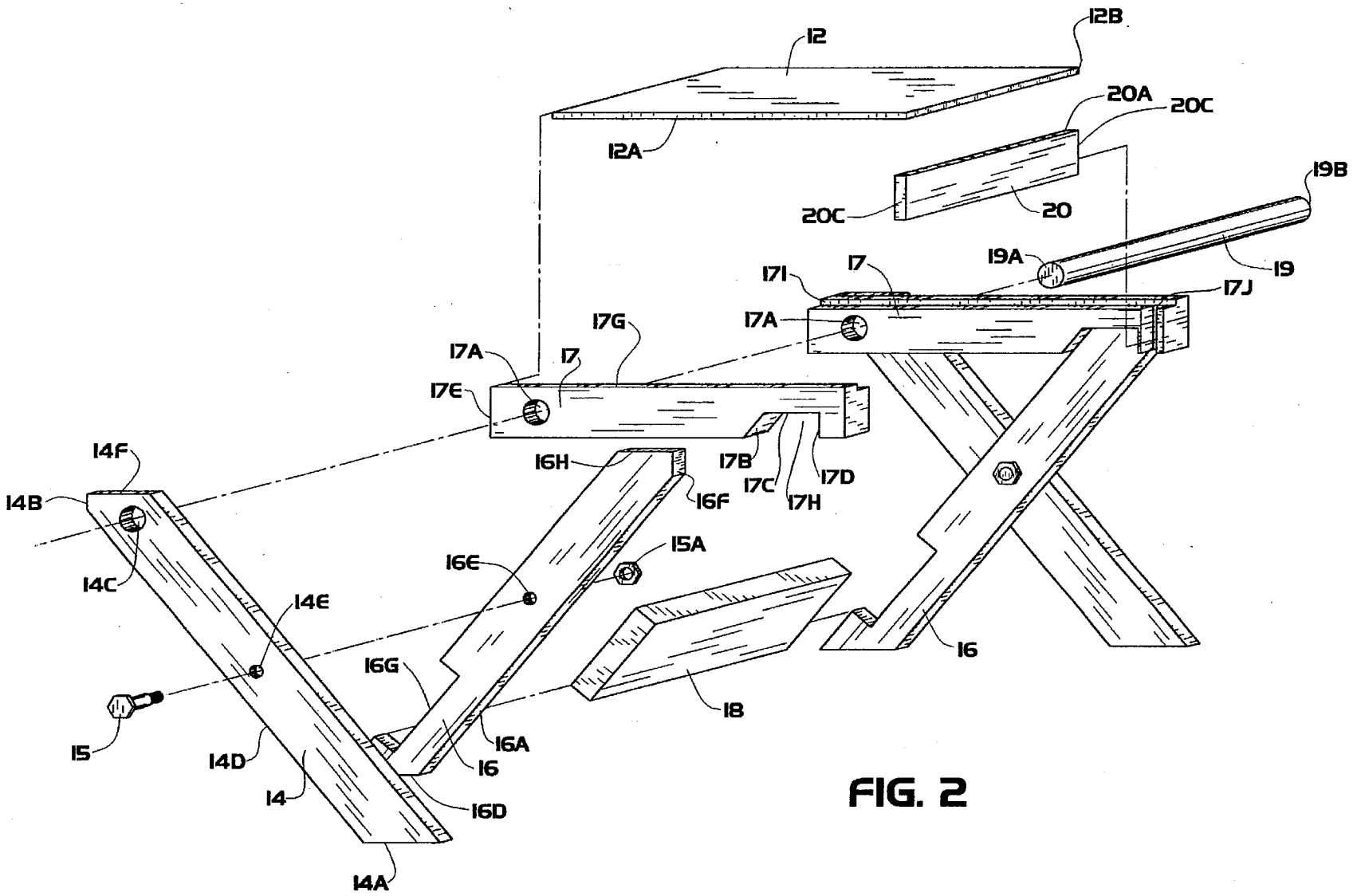
FIG. 2 is an exploded view of the folding article of furniture.

FIG. 1 is a perspective view, and FIG. 2 is an exploded view of an article of furniture 10 of the present invention.

The article of furniture 10 includes at least two outer legs 14, at least two inner legs 16, a panel portion 12, a joining piece 18, a dowel 19, a crossmember 20 and at least two side pieces 17.

As seen in FIGS. 1 and 2, the panel portion 12 has a panel portion longitudinal edge 12A and a panel portion width edge 12B. The panel portion 12 rests on the side pieces 17 and is fixedly attached so that the panel portion 12 remains sturdy and fastened.

The side pieces 17 each have a side piece aperture 17A, a side piece notch 17H, and a side piece slot 17J. The side pieces 17 further have a side piece longitudinal edge 17G and a side piece width edge 17E. The side piece notch 17H has a side piece notch first edge 17B, a side piece notch second edge 17D and a side piece notch top edge 17C. The panel portion 12 rests within the side piece groove 171.

The outer legs 14 each have an outer leg aperture 14C, outer leg longitudinal edge 14D, outer leg width top edge 14F, outer leg width bottom edge 14A, and an outer leg bevel 14B. The outer leg bevel 14B is positioned at the intersection of the outer leg width top edge 14F and the outer leg longitudinal edge 14D.

Figure 3A:
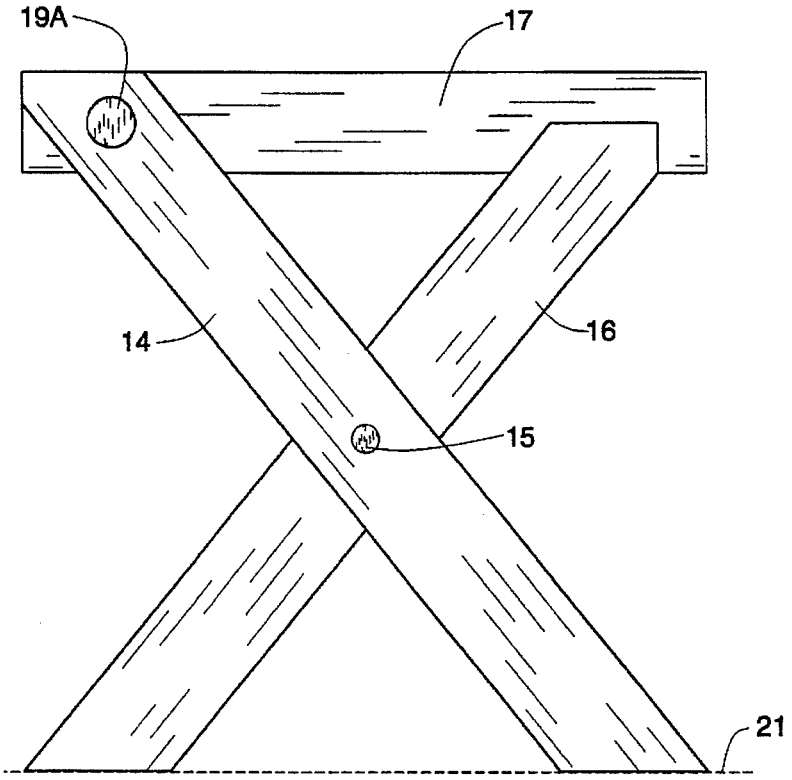
FIG. 3A is side view of the folding article of furniture in an upright position.
Figure 3B:
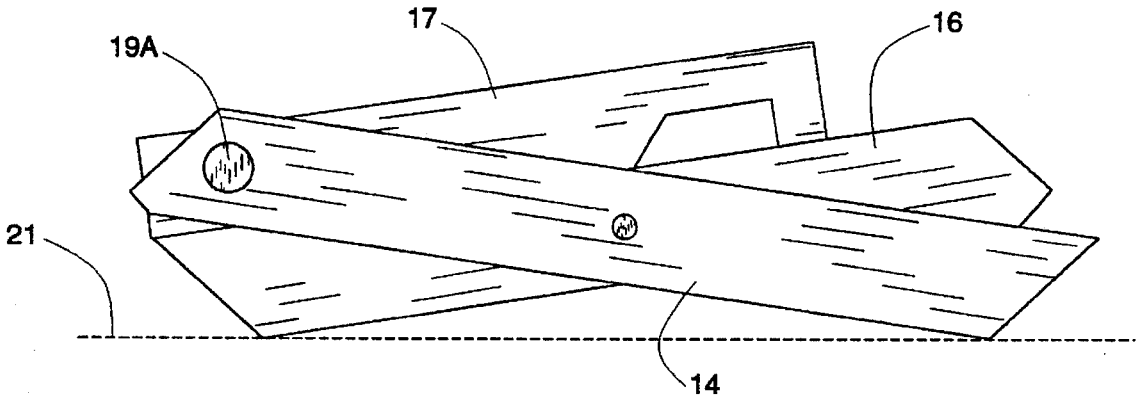
FIG. 3B is a side view of the folding article of furniture in a folded position.

The dowel 19 is disposed within the side piece aperture 17A and the outer leg aperture 14C so that the outer legs 14 can swing about the axis of the dowel 19 and allow the article of furniture 10 to move from an upright position (first position) as shown in FIG. 3A, to a folded position (second position) as shown in FIG. 3B. The dowel 19 may be fixedly connected to either the side pieces 17 or the outer legs 14, but not to both. In either the upright or the folded position, panel portion 12 may be used as a sitting surface or as a table surface.

The inner legs 16 each have an inner leg longitudinal edge 16A, an inner leg width edge 16H, an inner leg aperture 16E, an inner leg bevel 16F, and an inner leg notch 16G. The inner leg bevel 16F is positioned at the intersection of inner leg longitudinal edge 16A and the inner leg width edge 16H. The inner leg aperture 16E is positioned so that a nut 15A and a bolt 15, fastens the outer leg 14 to the inner leg 16. The bolt 15 is disposed within the inner leg aperture 16E and the outer leg bolt aperture 14E. Alternatively, the outer leg 14 may be fastened to the inner leg 16 by a pin and cotter pin (not shown), or a push pin (not shown). The side piece notch 17H is positioned so that in a first upright position the inner leg width edge 16H can be inserted into the side piece notch 17H, and the inner leg bevel 16F fits in to side piece notch 17H and is resting against the side piece notch second edge 17D.

The crossmember 20 contains a crossmember longitudinal edge 20A and two crossmember width edges 20C. The crossmember width edges 20C are fixedly attached in place within the side piece slots 17J in each side piece 17. The panel portion 12 is fixedly attached to the crossmember 20.

The joining piece 18 is fixedly attached within each of the inner leg notches 16G. This adds stability and sturdiness to the folding article of furniture.

The article of furniture can be manufactured from wood, plastic, metal, or other suitable material.

The means for fixedly attaching the various members of the invention to each other may be nails, bolts, glue, or other suitable means.

Conclusion, Ramifications, and Scope

It will be understood that each of the elements described above, or two or more together, may also find a useful application in other types of constructions differing from the type described above.

The invention is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An article of furniture comprising:

a. a panel portion;

b. at least two side pieces attached to said panel portion, each of said side pieces containing a side piece notch and a side piece aperture;

c. at least two outer legs each of which containing an outer leg aperture and an outer leg bolt aperture;

d. at least two inner legs each of which containing an inner leg notch and an inner leg aperture;

e. connecting means for rotatably connecting said outer leg to said inner leg, said connecting means disposed within said outer leg bolt aperture and said inner leg aperture;

f. a crossmember attached to each of said side pieces and said panel portion;

g. a joining piece attached within each of said inner leg notches of said inner legs;

h. a dowel disposed within each said outer leg aperture and each said side piece aperture so that said article of furniture can be moved from an upright position to a folded position;

i. each of said inner legs having an inner leg top width edge opposite and parallel to an inner leg bottom width edge, and an inner leg bevel perpendicular to said inner leg top width edge;

j. each of said outer legs having an outer leg top width edge opposite and parallel to an outer leg bottom width edge, and an outer leg bevel perpendicular to said outer leg top width edge; and k. said side piece notch configured to conformingly receive said inner leg top width edge and said inner leg bevel therein when said article of furniture is in said upright position.

2. The article of furniture of claim 1, wherein said article of furniture is manufactured from a material selected from the group consisting of wood, plastic, and metal.

3. The article of furniture of claim 1, wherein said connecting means includes a connector selected from the group consisting of nut and bolt, pin and cotter pin, and push pin.

* * * * *